US007066380B2

(12) United States Patent
Blake

(10) Patent No.: US 7,066,380 B2
(45) Date of Patent: Jun. 27, 2006

(54) CARTON CONFIGURED FOR AUTOMATED LOADING

(75) Inventor: John A. Blake, Brookfield, CT (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/996,347

(22) Filed: Nov. 28, 2001

(65) Prior Publication Data

US 2003/0098344 A1 May 29, 2003

(51) Int. Cl.
*B65D 5/72* (2006.01)

(52) U.S. Cl. ..... 229/122.1; 229/121; 229/243; 206/45.29

(58) Field of Classification Search ..... 229/122.1, 229/122.11, 221, 172, 169, 170, 138, 305, 229/122, 156, 126, 141, 142, 127, 243, 121; 207/737, 45.29; 221/305
See application file for complete search history.

(56) References Cited

U.S. PATENT DOCUMENTS

| | | | | |
|---|---|---|---|---|
| 177,279 | A * | 5/1876 | Ritter | 229/142 |
| 598,087 | A * | 2/1898 | Harker | 229/102 |
| 632,222 | A * | 8/1899 | Malatesta | 229/150 |
| 1,142,020 | A * | 6/1915 | Carver | 206/45.29 |
| 1,194,372 | A * | 8/1916 | Fischer | 229/122.1 |
| 1,367,048 | A | 2/1921 | Horr | |
| 1,472,953 | A | 11/1923 | Bamber | |
| 1,551,774 | A | 9/1925 | Reeves | |
| 1,558,494 | A | 10/1925 | Newton | |
| 1,609,186 | A | 11/1926 | Peruzzi | |
| 1,616,707 | A * | 2/1927 | Tanner | 206/45.29 |
| 1,743,502 | A | 1/1930 | Tanner | |
| 1,903,461 | A | 4/1933 | Keller | |
| 1,909,472 | A | 5/1933 | Keppler | |
| 2,148,533 | A | 2/1939 | Chapman | |
| 2,200,818 | A | 5/1940 | Bergstein | |
| 2,233,488 | A | 3/1941 | Powell | |
| 2,235,473 | A | 3/1941 | Blinstrub | |
| 2,249,430 | A | 7/1941 | Lambert | |
| 2,556,661 | A | 6/1951 | Rendall et al. | |
| 2,557,290 | A | 6/1951 | Houldsworth | |
| 2,649,240 | A | 8/1953 | Gilbert | |
| 2,684,792 | A * | 7/1954 | Kraus | 222/457 |
| 2,770,408 | A | 11/1956 | Lindeberg | |
| 2,771,986 | A | 11/1956 | Bekoff | |
| 2,803,390 | A * | 8/1957 | McKay | 229/122.1 |
| 2,847,153 | A * | 8/1958 | Reynolds et al. | 229/221 |

(Continued)

FOREIGN PATENT DOCUMENTS

GB 2 252 546 8/1992

OTHER PUBLICATIONS

Various press reports dated Jan. 2001, from www.adamsbodysmarts.ca/news.html.*

(Continued)

*Primary Examiner*—Tri M. Mai
(74) *Attorney, Agent, or Firm*—Fitch, Even, Tabin & Flannery

(57) ABSTRACT

A carton having a door and a method of making a carton having a door, the carton being adapted for automated assembly and/or loading by reducing or eliminating interference between side panels of a door and product during loading and use of the door. In an aspect of the invention, the door side panels are slidable within a protected region formed between adjacent panels of the carton.

15 Claims, 9 Drawing Sheets

U.S. PATENT DOCUMENTS

| | | | | | |
|---|---|---|---|---|---|
| 2,886,232 | A | | 5/1959 | Leone | |
| 2,907,512 | A | | 10/1959 | Leone | |
| 3,161,341 | A | | 12/1964 | Farquhar | |
| 3,207,380 | A | | 9/1965 | Hennessey | |
| 3,478,948 | A | * | 11/1969 | Dornbush | 229/122 |
| 3,528,597 | A | | 9/1970 | Zastrow | |
| 3,536,247 | A | | 10/1970 | Gadiel | |
| 3,568,877 | A | | 3/1971 | Mastrud, Jr. | |
| 3,568,911 | A | * | 3/1971 | Bebout | 229/122.1 |
| 3,593,908 | A | * | 7/1971 | Desmond et al. | 229/122.1 |
| 3,729,091 | A | | 4/1973 | Davis | |
| 3,944,128 | A | | 3/1976 | Hogan | |
| 4,186,866 | A | | 2/1980 | Zicko | |
| 4,283,000 | A | | 8/1981 | White | |
| 4,317,536 | A | | 3/1982 | Dickerson | |
| 4,602,735 | A | * | 7/1986 | Aaron | 229/122.1 |
| 4,752,029 | A | | 6/1988 | Buford | |
| 5,458,272 | A | | 10/1995 | Ward-Weber | |
| 5,626,283 | A | | 5/1997 | Mellon | |
| 6,189,778 | B1 | * | 2/2001 | Kanter | 229/122.1 |

OTHER PUBLICATIONS

Photocopy of the carton blank for the Adams Body Smarts box previously disclosed in the IDS dated Nov. 28, 2001.

* cited by examiner

CARTON CONFIGURED FOR AUTOMATED LOADING

FIELD OF THE INVENTION

The invention relates generally to a carton, and particularly to a carton configured for automated loading.

BACKGROUND OF THE INVENTION

Cartons are often used to ship a variety of consumer products. The products may be unloaded from the carton at the destination or point of sale and placed on vending racks, shelves, or other displays. The emptied carton then may be reused for shipping other products, recycled, or otherwise disposed of. In order to reduce costs, such as those associated with unloading cartons and displaying the products unloaded therefrom, cartons have been developed that may function not only for shipping, but also as displays at the point of sale. The carton may have colorful graphics or other images advertising the product, and may include one or more doors or openings for providing access to the product therein.

Cartons are typically formed from blanks cut from paperboard, corrugated board, or other material. The blanks, generally planar, unfolded cartons may be assembled into cartons either manually or using automated equipment. The formed cartons may also be loaded with products either manually or using automated equipment. Manual assembly and loading of cartons is time-consuming and can be costly as compared to the use of automated equipment. However, automated equipment can require a large investment. Thus, it is desirable for automated equipment to be versatile and able to form and/or load a variety of different carton types and configurations.

Providing doors with side panels or portions extending between the doors and the cartons may improve the appearance and functioning of the door. For example, a door may be provided having side panels adapted for limiting the opening of the door relative to the carton and/or reducing spillage of product. However, providing door side panels can complicate the assembly of the carton, and may require expensive customization of automated equipment for assembling such cartons. Thus, it is desirable to provide for the automated assembly of cartons having doors with side panels.

Furthermore, door side panels may interfere with the loading of product into the interior of the carton. When loaded manually, care may be taken to reduce interference between the door side panels and the product. As discussed above, however, manual loading of cartons can be costly compared to the use of automated equipment. In addition, side panels of doors may interfere with the opening and closing of the doors when the carton is loaded with product. For example, product may interfere with the movement of the door side panels from open to closed positions. Thus, it is desirable to provide cartons having doors with side panels that are configured to reduce or eliminate interference between the door side panels and the product.

SUMMARY OF THE INVENTION

In accordance with the invention, a carton and a method of assembling and loading a carton using automated machinery are provided, where the carton includes a door having side panels and is configured to limit or avoid interference between product within the carton and the side panels during loading and operation of the door. The side panels of the door are preferably provided in a slidable arrangement within a protected region formed between a pair of panels of the carton.

In a preferred embodiment of the invention, the carton may be formed from a blank comprising paperboard or another inexpensive material such that the carton is capable of inexpensive mass production, and is suitable for use as a display. The carton may be capable of assemble and/or loading using automated machinery, and preferably automated machinery that requires minimal customization to assembly and/or load the carton of the invention.

The carton, in its assembled state, preferably comprises a generally rectangular shape constructed of multiple panels. In particular, the carton may be constructed, in part, of a front panel, a back panel, a pair of side panels, a top panel, and a bottom panel defining the generally rectangular shape. Although specific panels are described herein, the carton is not limited to the specific panels mentioned, or the relative positioning of the panels.

The front panel preferably has a window opening formed therein for providing access to an interior of the carton and any product contained therein. A door or bin may be provided to selectively permit access to the interior of the carton. The door may comprise a front panel hinged relative to the front panel of the carton to permit movement of the door from a closed position, blocking the window opening and thereby restricting access to the interior of the carton, to an open position, whereby access to the window opening and thus the interior of the carton is permitted.

The door may also include a pair of side panels at opposite ends thereof. The door side panels may each include a stop member formed thereon for limiting the opening of the door front panel relative to the front panel of the carton. When the front door panel is in its closed position, the door side panels may be substantially recessed within the interior of the carton. However, as the front door panel is moved to its open position, the side panels extend between the door and the carton until engagement of the stop members of the door side panels against the interior of the front panel limits further outward movement.

To reduce or eliminate interference between the product and the door side panels, the door side panels may be positioned within a protective region formed between at least two panels, and preferably between two substantially adjacent panels. Providing the door side panels in the protective region may avoid interference between the door side panels and the product during loading, enabling use of automated machinery therefor. In addition, the protected door side panels may also avoid interference between the door side panels and the product when the front door panel, and thus the door side panels, moves between its open and closed positions.

In an aspect of the invention, a pair of dual carton side panels, perpendicular to a carton front panel, may be arranged on each side of the carton to provide the protective regions in which the door side panels are slidable. The carton side panels may extend at least above the height of the door side panels when the door is in its closed position, and preferable extend substantially the full height of the carton.

In an aspect of the invention, each dual carton side panel may comprise a first side panel hinged to both a second side panel and an edge of either the front or back side panel. The first and second side panels may form a side of the carton. The protective region may be provided between the first and second side panels to enable the door side panels to slide freely therebetween.

In another aspect of the invention, a third side panel, hinged to the panel opposite the panel to which the first side panel is hinged, may also be provided for forming each side of the carton in conjunction with the first and second flaps or panels discussed above. The third side panels may be positioned to either overlay or underlay the first and second panels, while the door side panels are slidable within the protective regions formed between the first and second side panels.

In yet another aspect of the invention, only the first and third side panels may be provided on the carton and may form a protective region therebetween in which the door side panels are slidable.

According to an aspect of the invention, the back panel of the carton, opposite the front panel, may be provided with an opening and display feature. The opening and display feature may comprise a portion partially detachable from the back panel and movable to a generally upright orientation to both provide access to the interior of the carton and product therein and to provide a display panel that may be presented to consumers, such as with advertising, information, or an attractive design or graphics.

The display panel may be folded into two separate portions to reduce the size and/or strengthen the panel. One of the portions of the display panel may be connectively hinged relative to either the top or bottom panel, such that when removed from the back panel it may be moved to its generally upright position. The other portion of the display panel may then be folded downwardly, and may include a tab that is insertable into a slot in either the top or bottom panel to maintain the upright and folded display in position relative to the carton.

In an aspect of the invention, the carton may be provided with both the window opening and door feature on the front panel and the opening and display feature on the back panel, improving the versatility of the carton. The carton may be convertible between a state where the door feature provides access to the interior of the carton and a state where the display feature provides access.

According to another aspect of the invention, the carton is formed from a blank comprising at least front, back, side, top, and bottom panels. The side panel for each side of the assembled carton may comprise a first, second, and/or third side panel as described hereinabove.

The blank may be provided in a partially assembled state, wherein an essentially collapsed carton is provided. The collapsed, partially assembled carton may be substantially planar, wherein the first and third side panels are coplanar with the front panel and back panel, respectively. The door front panel and door side panels may be substantially coplanar with the front panel, with the door side panels extending into the protective region formed between the juxtaposed first and second side panels. The front and back panels, and thus the first and third side panels, may be substantially adjacent each other. The top and bottom panels, each connected at opposing edges thereof to both the front and back panels, are also in a coplanar arrangement with the other panels.

Providing the carton in a partially assembled, collapsed arrangement may allow for simplified further assembly and loading of product thereinto. Automated machinery, such as conventional carton forming and loading machinery, may be used to convert the collapsed carton into an erect, but still only partially assembled, state. In the erect state, the front and back panels are spaced apart from each other and the top and bottom panels are moved into a generally perpendicular arrangement therewith. The side panels, and thus the door side panels, may still remain generally coplanar with their respective front or back panel. Accordingly, the erect and partially assembled carton resembles an open rectangle, with the sides of the rectangle defined by the top, bottom, front, and back panels.

The erect and partially assembled carton may be loaded with product via either of the open side panels. Automated machinery may be used to insert the product between the top, bottom, front, and back panels. In this configuration, the door side panels may remain within the protecting region formed between the first and second side panels and thus removed from interfering with the loading product. After the loading of product by the automated machinery, the side panels may be moved to a closed position, substantially perpendicular relative to the front and back panels, to complete assembly of the carton and define an interior thereof where the product is retained.

DETAILED DESCRIPTION OF THE INVENTION

Figure 1:
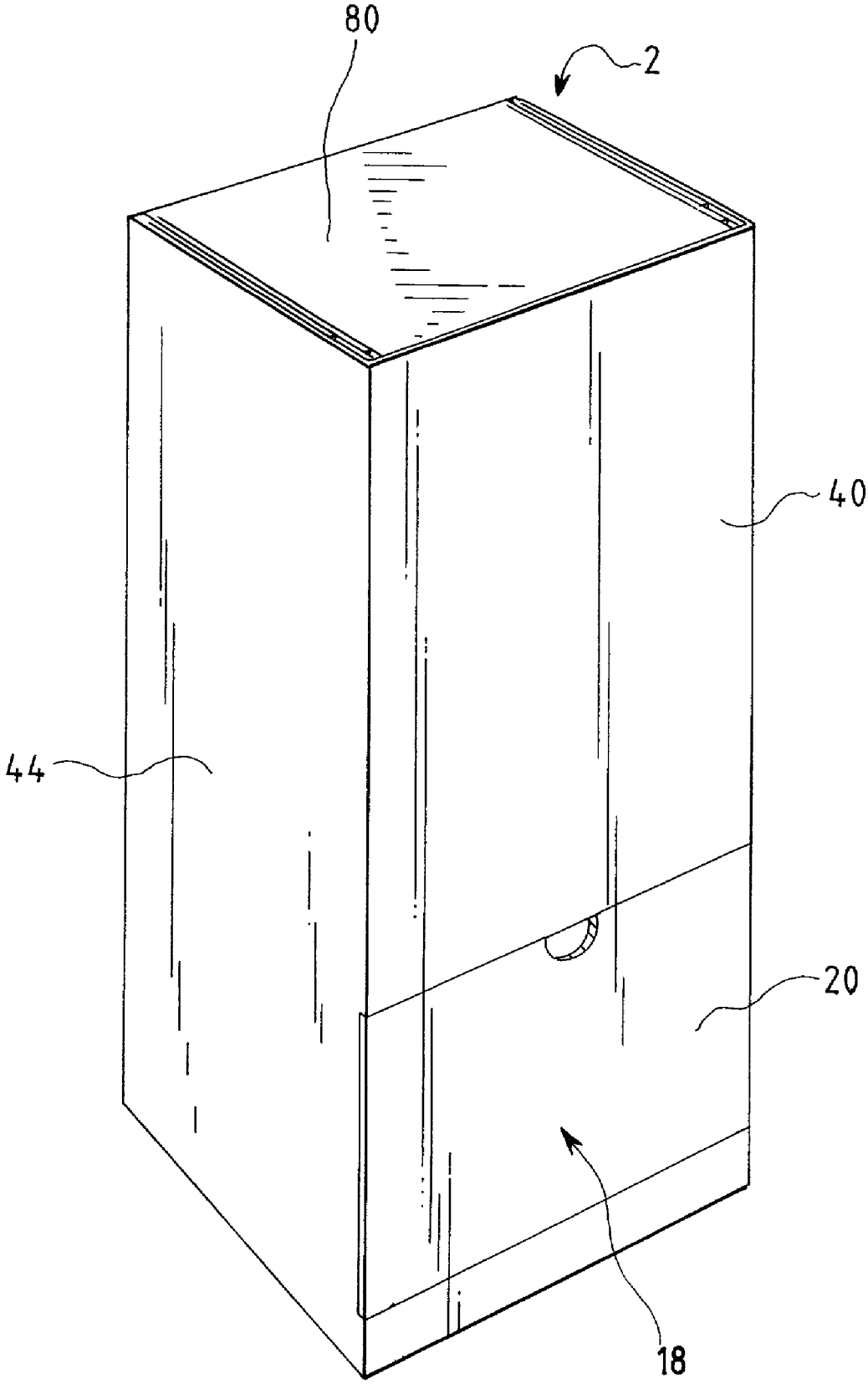
FIG. 1 is a perspective view of a carton according to an embodiment of the invention, showing a door in a closed position.

The invention is preferably embodied in a carton 2 and a method of making the carton 2 for reducing interference between side panels 30 of a door 18 and product 6 during loading of the carton 2, such as with automated machinery, and operation of the door 18. The preferred aspects of the invention, wherein the door side panels 30 are slidable within a protective region 36 during loading of product 6 and operation of the door 18, are disclosed below.

FIGS. 1–7 illustrate a carton 2 assembled from a blank 4 and configured for reducing interference between the door side panels 30 and the product 6, during both loading of the product 6 into the carton 2 and during operation of the door 18 of a loaded carton 2, in accordance with aspects of the invention. To reduce or eliminate interference between the product 6 and the door side panels 30, the door side panels 30 are provided within a protective region 36. In a preferred aspect of the invention, the protective regions 36 are each formed between pairs of side flaps or panels 44 and 46 that comprise the sides of the carton 2, as will be described further hereinbelow.

FIG. 1 illustrates a carton 2 in accordance with preferred aspects of the invention. The carton 2 is generally rectangular in shape, comprising front and back panels 40 and 50, a pair of side panels 44, and a top and bottom panel 70 and 80. A window opening 42 is provided on the front panel 40 for permitting access to the interior of the carton 2 and any product 6 contained therein.

Figure 2:
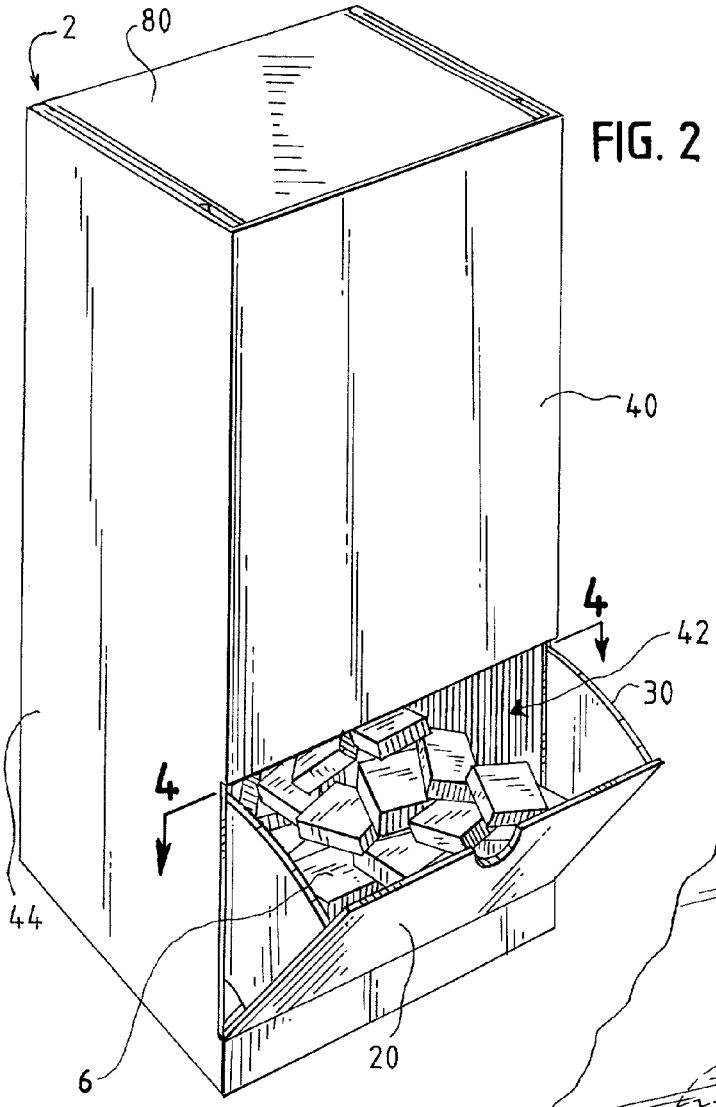
FIG. 2 is a perspective view of the carton of FIG. 1, showing the door in an open position.

As illustrated in FIG. 2, the door 18 is provided for blocking the window opening 42 of the front panel 40. The door 18 is selectively movable between a closed position for blocking the window opening 42, illustrated in FIG. 1, and an open position for permitting access to the interior of the carton 2, as illustrated in FIG. 2.

The door 18 comprises a door outer panel 20 pivotable about a fold or hinge 22 between open and closed positions. Attached to the inside of the door outer panel 20 is a door inner panel 10, itself hinged about fold 12 relative to a bottom portion 16. Extending from opposite edges of the inner door panel 10 are a pair of door side panels 30. The door side panels 30 limit the outward extension of the door panels 10 and 20, as will be described in greater detail hereinbelow. In addition, the door side panels 30 may prevent product 6 from overflowing when the door 18 is moved between its closed and open positions. Stability of the door 18 relative to the carton 2 may also be improved by the presence of the door side panels 30. In order to avoid interference between the door side panels 30 and the product, such as during loading or operation of the door 18, the door side panels 30 are slidable within the protective region 36, as will be described below. Aligned notches 14 and 24 are provided on the inner and outer door panels 10 and 20, respectively, for facilitating opening of the door 18 from its closed position.

Figure 4:
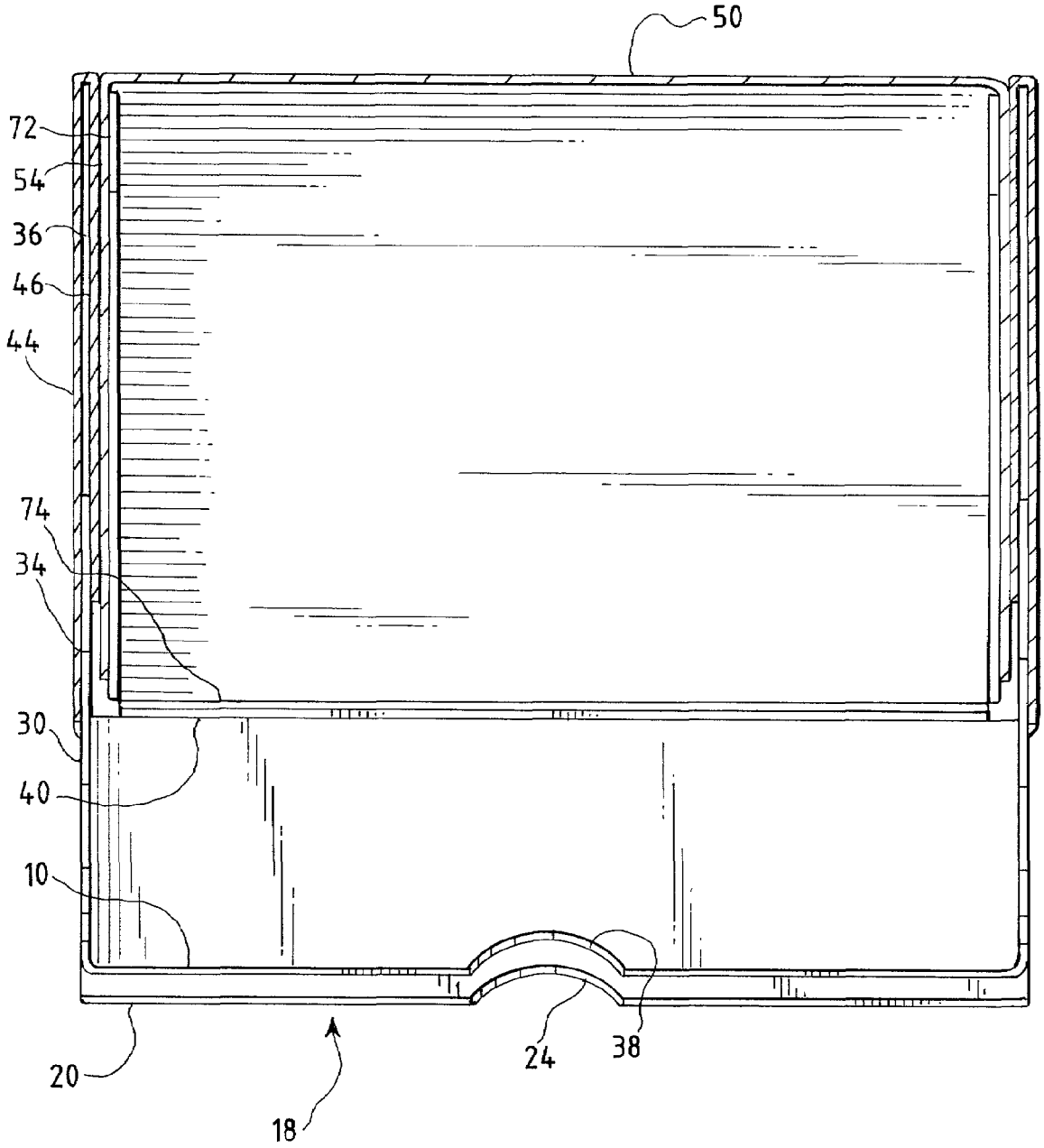
FIG. 4 is a section view taken along lines 4—4 of FIG. 2.

The side panels of the carton may comprise three separate side panels 44, 46, and 54, as illustrated in FIG. 4. These separate side panels 44, 46 and 54 may include first major front flaps 44 each attached along an edge thereof via folds to opposing longitudinal edges of the front panel 40. On edges opposite the folds between the first major front flaps 44 and the front panel 40, second major front flaps 46 are provided with a fold therebetween. The first and second major front flaps 44 and 46 are provided generally adjacent each other and defining the protective region 36 therebetween. To complete the sides of the carton 2, edges of a pair of back major panels 54 are attached via folds to opposite longitudinal edges of the back panel 50. The back major panels 54 each underlay the respective first and second major front panels 44 and 46, as illustrated in FIG. 4, innermost relative to the interior of the carton 2.

Figure 5:
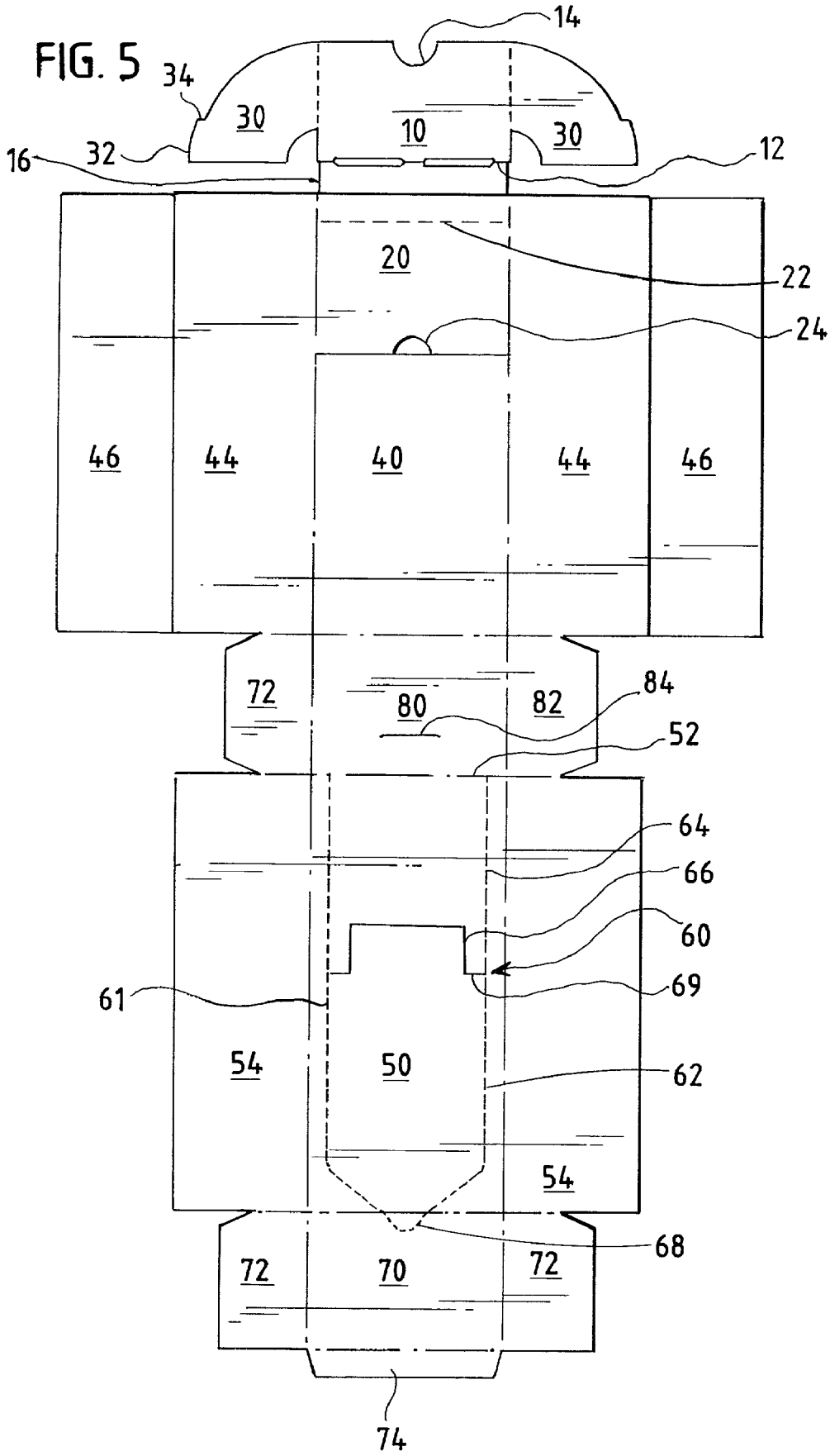
FIG. 5 is a plan view of a blank for forming a carton according to an embodiment of the invention.

The side door panels 30 are each slidable within the protected regions 36 formed between the first and second major front panels 44 and 46, as illustrated in FIGS. 4 and 5. As the door 18 is moved between its closed and open positions, the door side panels 30 are freely slidable within the protective regions 36. The second major front panels or flaps 46 provide a barrier between the interior of the carton 2 and the door side panels 30, thereby reducing interference between the product loaded therein and the door side panels 30. The protective regions 36 are also configured to eliminate or avoid interference between the door side panels 30 and the product during loading thereof, which will be described in more detail below.

Figure 3:
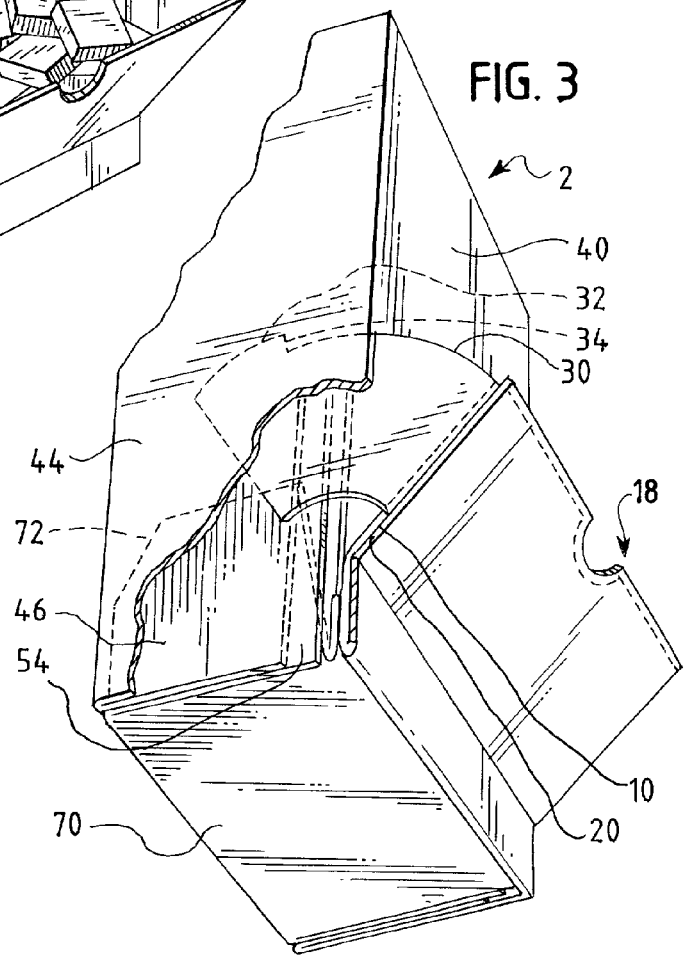
FIG. 3 is a perspective view of the carton of FIG. 1, showing a side panel partially removed and the door in the open position.

The door side panels 30 each include a protruding portion 32 for limiting the extension of the door relative to the carton 2. The protruding portions 32 each include an edge 34, as illustrated in FIG. 3, that is positioned to engage the interior of the front panel 40 of the carton 2 when the door 18 is fully moved to its open position, thereby limiting further opening of the door 18. The restriction of the outward movement of the door 18 may be useful to maintain the product 6 within the carton 2 and prevent spillage therefrom, such as if the door 18 were moved to a position beyond its limited open position.

Figure 6:
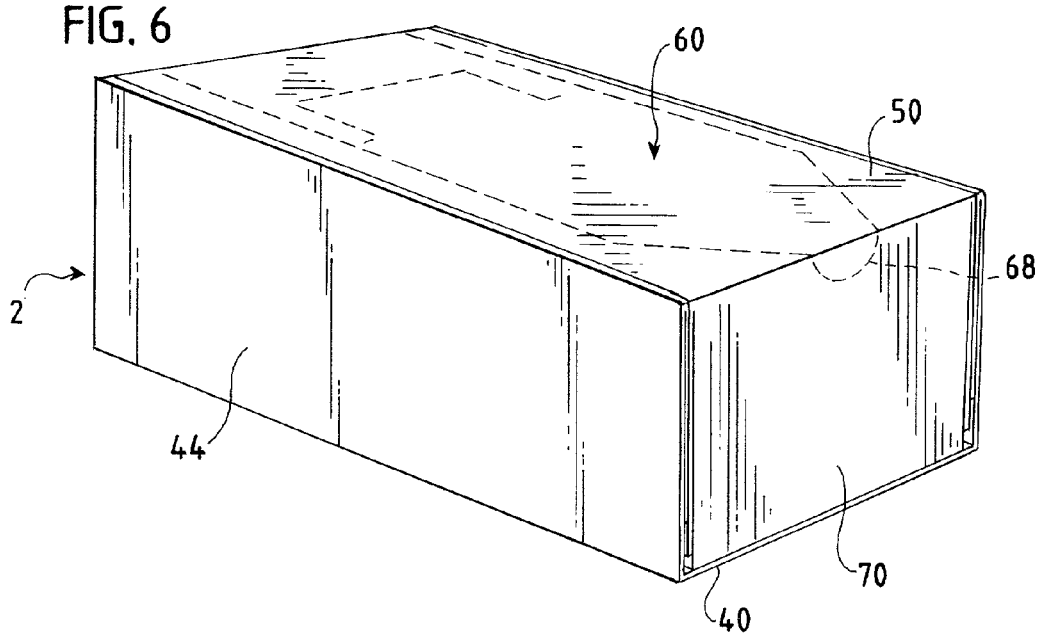
FIG. 6 is a perspective view of a carton according to an embodiment of the invention, showing a display panel in a closed position.
Figure 7:
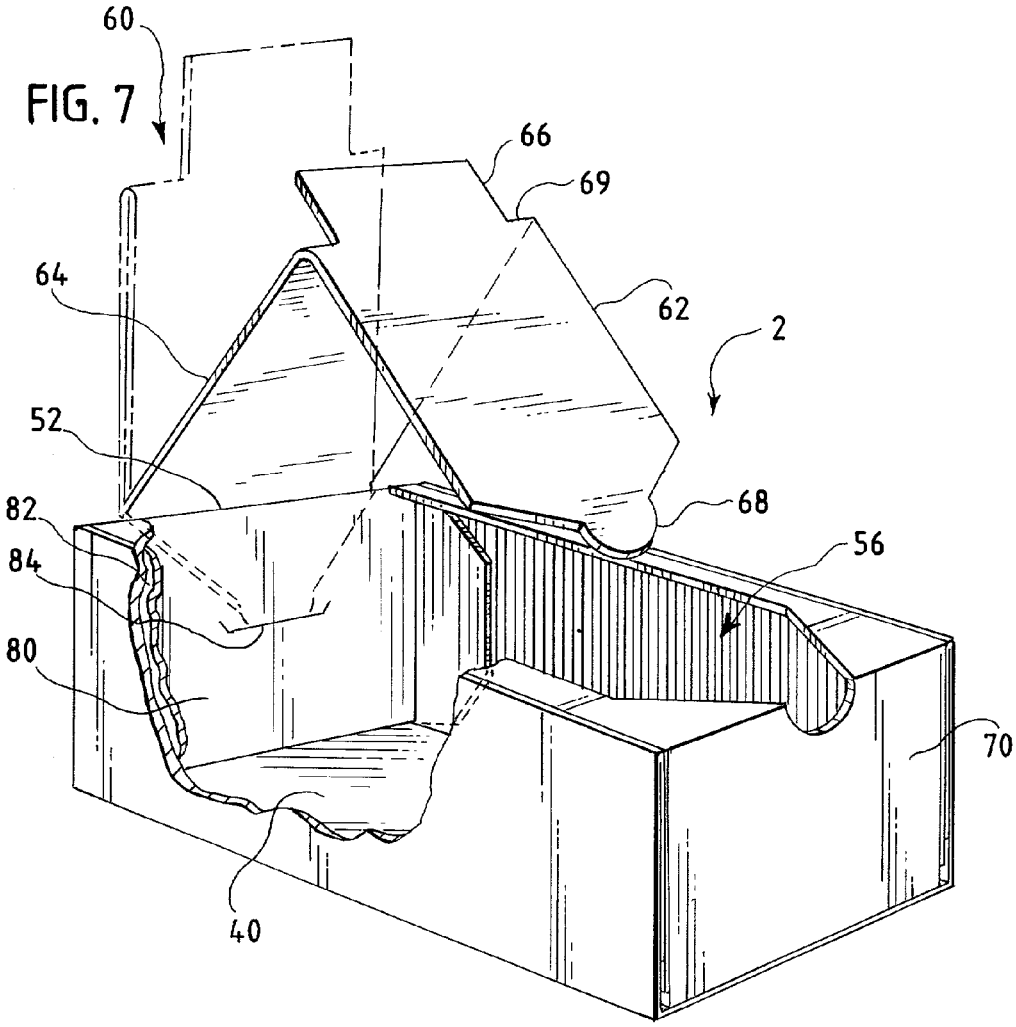
FIG. 7 is a perspective view of a carton according to an embodiment of the invention, showing the display panel between the closed and an open position.
Figure 8:
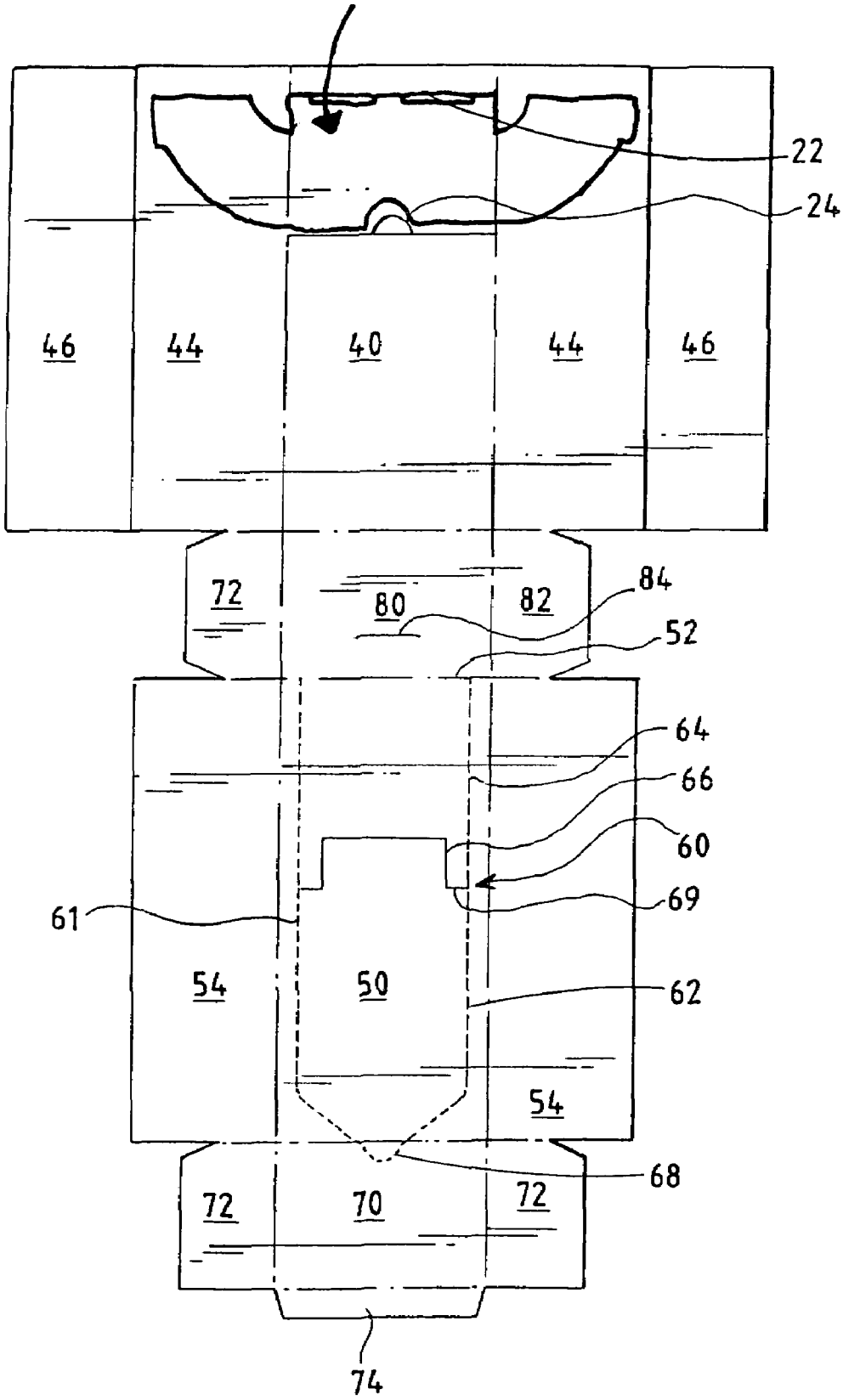
FIG. 8 is a plan view of an intermediate form of the carton assembled from the carton blank of FIG. 5.
Figure 9:
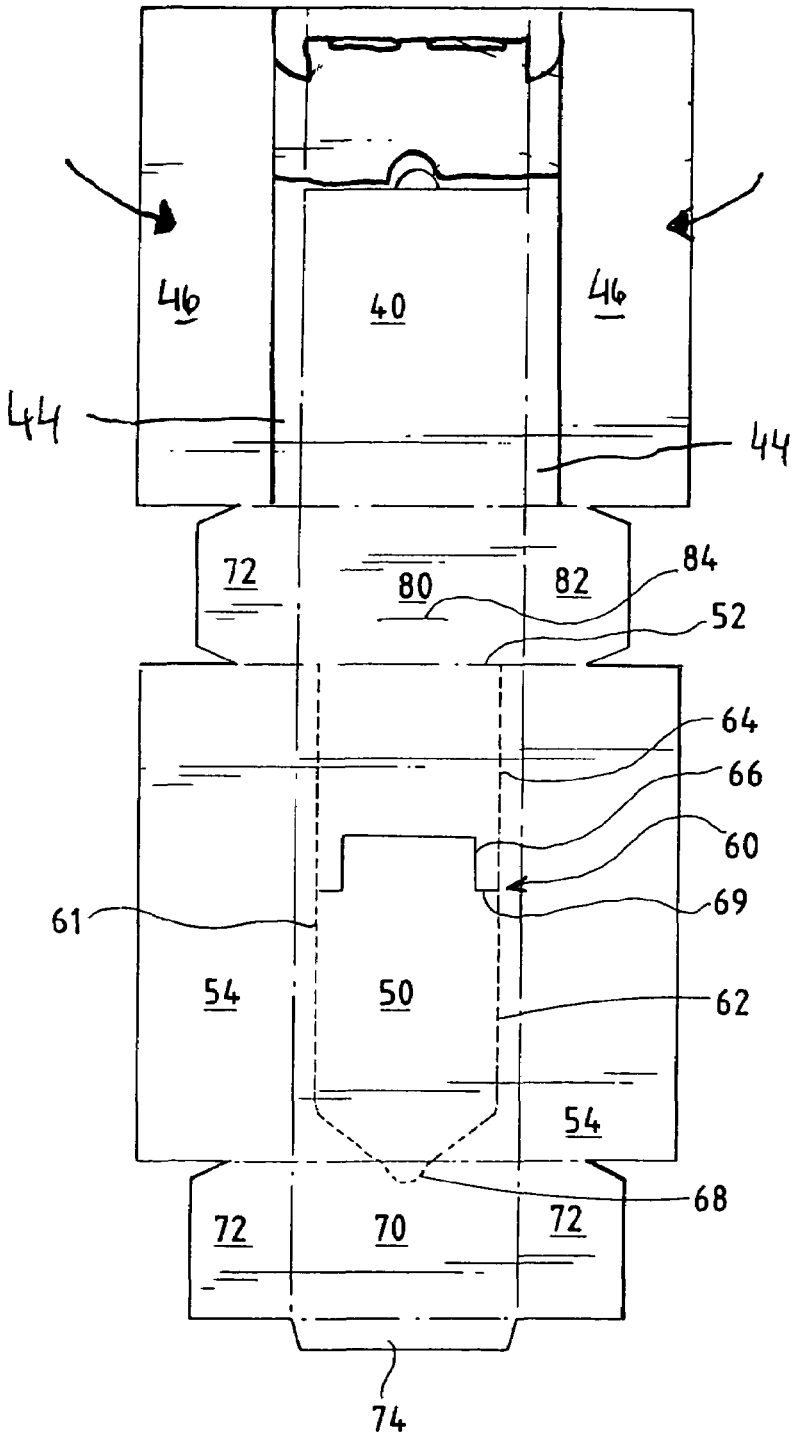
FIG. 9 is a plan view of an intermediate form of the carton assembled from the carton blank of FIG. 5 after the form shown in FIG. 8.

The back panel 50 of the carton 2 may be provided with an opening and display feature 60, as illustrated in FIGS. 6 and 7, thereby allowing the carton 2 to have two different configurations each having an opening feature. The display feature 60 may comprise a display panel 62 and a support panel 64 integrally disposed on the back panel 50 and readily separable from the back panel 50 via perforations 61 therebetween.

When the panels 62 and 64 of the display feature are separated from the back panel 50, they are movable to a generally upright position, as illustrated in FIG. 7, via a hinge or fold 52 between the support panel 64 and the top panel 80. The display panel 62 is itself foldable downwardly about a hinge or fold 69 between the display panel 62 and the support panel 64, enabling the display panel 62 to be facing the window opening 56 in the back panel 50. Advertising, information, or other adornments may be placed on the display panel 62 for presentation to consumers. By having the display feature 60 comprise two separate and foldable panels 62 and 64, the same adornments visible on the display panel 62 in its open configuration are also visible when the display feature 60 is unused and still integral with the back panel 50. A tab 68 provided on display panel 62 is insertable into a slot 84 formed in the top panel 80 to maintain the display feature 60 in its upright orientation.

The carton 2 is assembled from the blank 4, illustrated in FIG. 5. As previously discussed, the assembled carton 2 of FIG. 1 comprises the front and back panels 40 and 50, the pair of side panels 44, and the top and bottom panels 70 and 80. Prior to assembly into the carton 2, the blank 4 is substantially planar. The front panel 40 has edges of the first major front panels 44 attached to longitudinal edges thereof. The second major front panels 46 have edges attached to the edges of the first major front panel 44 opposite the fold between the first major front panel 44 and the front panel 40.

In the blank state, the front panel 40 has attached at a bottom end a bottom portion 16, extending between the front panel 40 and the inner door panel 10. The inner door panel 10, which includes the door side panels 30 attached via folds at side edges thereof, is movable relative to the bottom portion 16 about a hinge or fold 12 therebetween.

The top panel 80 of the carton 2 is attached via a fold to an end of the front panel 40 opposite the bottom portion 16 and inner door panel 10. The top panel 80 extends from the front panel 40 to fold between the top panel 80 and the back panel 50. Top minor flaps 82 are disposed on opposing side edges of the top panel 80. The slot 84 is also provided in the top panel 80 for use with the tab 68 of the display feature 60, as described in greater detail hereinabove.

The back panel 50 has the major back panels 54 connected at opposing longitudinal edges thereof, as described hereinabove. The display feature 50, including the display support 64 and the display panel 62, are integral with the back panel 50 and attached thereto with the perforations 61.

The end of the back panel 50, opposite the fold between the back panel 50 and the top panel 80, has attached thereto via a fold the bottom panel 70. Similar to the top panel 80, the bottom panel 70 includes a pair of bottom minor flaps 72 on opposite sides thereof. An edge of the bottom panel 80, opposite the connection with the back panel 50, has attached thereto a bottom longitudinal flap 74 for use in assembling the carton 2, as will be described further.

Although a preferred blank 4 arrangement has been described above, other blank arrangements, i.e., the relative positioning and/or presence of the various panels, may be equally suitable for forming a carton according to the aspects of the invention described herein.

The carton blank 4 can be assembled into the carton 2 using assembly steps resulting in intermediate forms, such as those illustrated in FIGS. 8–11. The blank 4 is assembled into the carton 2 from the planar arrangement, illustrated in FIG. 5, by first partially assembling the blank 4 into a collapsed state. In the collapsed carton state, the bottom portion 16 is folded against and attached to the bottom portion of the interior of the front panel 40, thereby placing the inner door panel 10 adjacent and coplanar with the outer door panel 20, as shown by the arrow in FIG. 8. The inner door panel 10 is attached to the interior of the outer door panel 20 with adhesive, and the panels 10 and 20 are positioned such that their respective hinges 12 and 22 are aligned.

At this point, the door side panels 30 are overlaying the first major front panels 44. The second major front panels 46 are then each folded along their connections to the first major front panels 44, as shown by the arrows in FIG. 9, thereby forming the protective region 36 therebetween and trapping the door side panels 30 therein. The first and second major front panels 44 and 46 may be adhered together; however, care is taken to ensure that the protective region 36 remains defined therebetween and free from adhesive to permit the free sliding the door side panels 30 therein. In a preferred aspect of the invention, adhesive is applied in three strips perpendicular to the longitudinal length of the first and second front major panels 44 and 46, the strips generally being at opposite ends thereof and in the midsection.

After the above operations to the door panels 10 and 20 and the major front side panels 44 and 46, the carton is then partially assembled into its collapsed state by attaching the bottom longitudinal flap 74 to the interior of the bottom portion 16, itself in turn attached to the front panel 40. The attachment of the flap 74 may occur by moving the bottom panel 70 against the inside of the back panel 50 by folding along the connection therebetween, and then folding the along the connection between the top panel 80 and the front panel 40 to bring the bottom portion 16 against the flap 74 for adhesion thereto.

Figure 10:
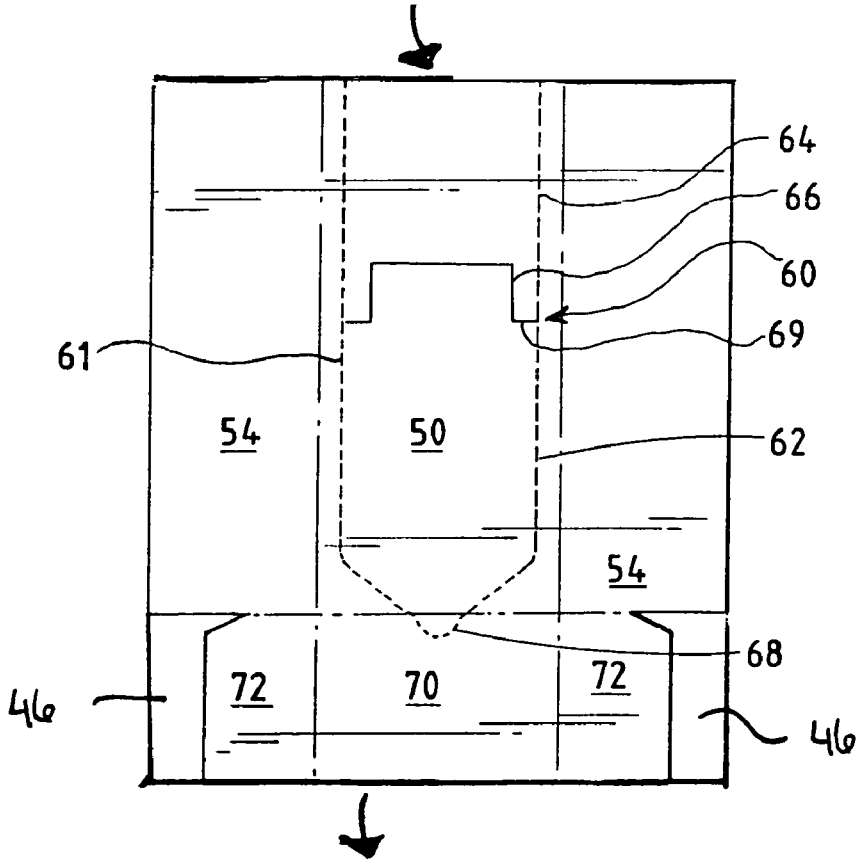
FIG. 10 is a plan view of an intermediate form of the carton assembled from the carton blank of FIG. 5 after the form shown in FIG. 9.
Figure 11:
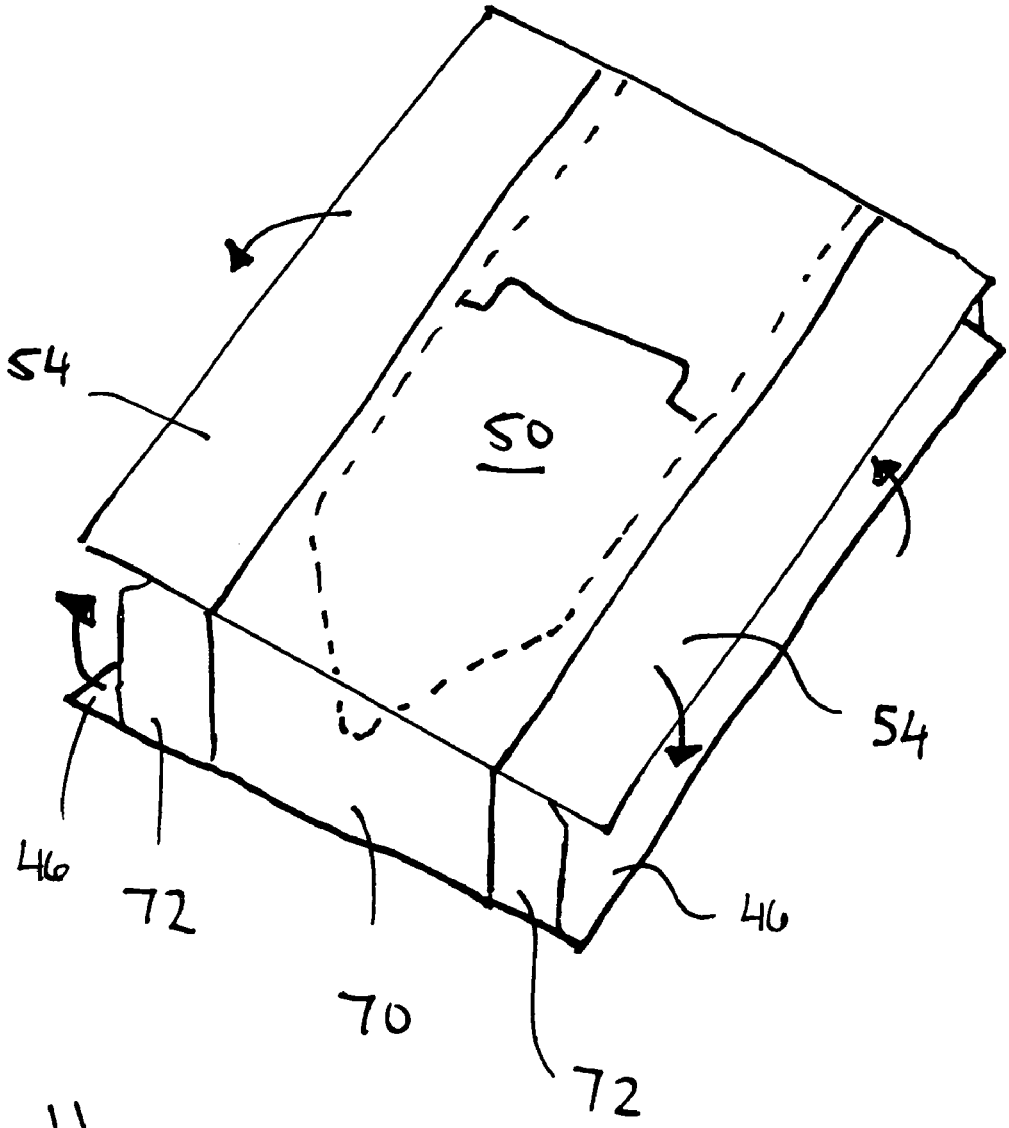
FIG. 11 is a perspective view of an intermediate form of the carton assembled from the carton blank of FIG. 5 after the form shown in FIG. 10.

After the attachment of the flap 74 to the bottom portion 16, the partially assembly carton is in its collapsed state, wherein the panels are all substantially coplanar with each other, as shown in FIG. 10. Conversion from the collapsed state to a partially assembled but erect state occurs by urging against the top and bottom panels 80 and 70. Specifically, a force directed against the fold between the front and top panels 40 and 80, and against the fold between the back and bottom panels 50 and 70, as shown by the arrows in FIG. 10, will cause movement to the erect state. In the erect state, shown in FIG. 11, the top and bottom panels 80 and 70 are generally perpendicularly oriented relative to the now spaced apart front and back panels 40 and 50. In the erect state, the attached front major panels 44 and 46 remain coplanar with the front panel 40, and the back major panels 54 remain coplanar with the back panel 50.

In the erect state, product 6 may be inserted between the top, bottom, front, and back panels 80, 70, 40, and 50, such as with automated machinery. During loading, the protective regions 36 formed between the panels 44 and 46 prevent interference between the door side panels 30 and the product 6.

After loading of the product 6, the carton 2 may be finally assembled from the erect state. To assemble the carton 2, the top and bottom minor panels 82 and 72 are folded in a perpendicular arrangement relative to the top and bottom panels 80 and 70, respectively. The back major panels 54 may be moved perpendicularly relative to the back panel 50. To complete the assembly of the carton 2, the attached first and second front major panels 44 and 46 with the door side panels 30 therein are folded against and attached to the back major panel 50.

The order of the above steps of assembling the carton 2 from the blank 4 described above is preferred, but other orders of assembly may also be equally suitable and in accordance with aspects of the invention described herein. Furthermore, some or all of the above assembly operations may be omitted and still within the scope of the aspects of the invention.

From the foregoing, it will be appreciated that the invention provides a carton and a method of making a carton adapted for automated assembly and/or loading by reducing interference between side panels of a door and product during loading and use of the door. The invention is not limited to the aspects and embodiments described hereinabove, or to any particular embodiments. Various modifications to the carton, blank, and assembly operations will result in substantially the same invention.

The invention is defined more particularly by the following claims:

1. A carton for containing one or more products, the carton comprising:

a front panel;

a first product dispensing configuration wherein the product is accessible through a window formed in the front panel; and a door selectively providing access to the first window, the door having a first portion being slidable between substantially adjacent first and second major panels being substantially the same length, substantially overlying each other and connected to each other effective to reduce interference between the product and the door portion during opening and closing of the door, the first and second major panels being parallel to a back major panel and one of the first and second major panels substantially overlying the back major panel, the back major panel having substantially the same length as the first and second major panels, and the back major panel being connected to a back panel, the back panel being opposite the front panel and parallel thereto.

2. A carton according to claim 1, wherein the carton is convertible between the first product dispensing configuration a second product dispensing configuration effective to allow product access through a window formed in the back panel.

3. A carton according to claim 2, wherein the door comprises a second portion being slidable between a second pair of substantially adjacent first and second major panels, the first and second major panels disposed opposite the other pair of first and second major panels.

4. A carton according to claim 3, wherein the first and second portions of the door are effective to limit the outward extension of the door relative to the front panel.

5. A carton in accordance with claim 1, wherein the first major panel is connected on one edge to the front panel and on an opposite edge to the second major panel, and an edge of the back major panel is connected to the back panel.

6. A carton in accordance with claim 5, wherein the back major panel substantially overlies the first major panel.

7. A carton in accordance with claim 5, wherein the back major panel substantially overlies the second major panel.

8. A carton in accordance with claim 5, wherein the back major panel is disposed exteriorly of the carton relative to the first and second major panels.

9. A carton in accordance with claim 5, wherein the back major panel is disposed interiorly of the carton relative to the first and second major panels.

10. A carton in accordance with claim 2, wherein the first major panel is connected on one edge to the front panel and on an opposite edge to the second major panel, and an edge of the back major panel is connected to the back panel.

11. A carton in accordance with claim 10, wherein the back major panel substantially overlies the first major panel.

12. A carton in accordance with claim 10, wherein the back major panel substantially overlies the second major panel.

13. A carton in accordance with claim 10, wherein the back major panel is disposed exteriorly of the carton relative to the first and second major panels.

14. A carton in accordance with claim 10, wherein the back major panel is disposed interiorly of the carton relative to the first and second major panels.

15. A carton for containing one or more products, the carton comprising:

a front panel and a back panel spaced apart and generally parallel;

a window formed in the front panel;

a door selectively providing access to the first window, the door having a pair of side portions;

a pair of first and second major panels having substantially the same lengths, one of the first major panels being connected at one edge to an edge of the front panel and at an opposite edge to one of the second major panels and the other of the first major panels being connected at one edge to an edge of the front panel and at an opposite edge to the other of the second major panels, each of the connected first and second major panels overlying each other to form a protected region for one of the side portions of the door; and a pair of back major panels each being connected at one edge to opposing edges of the back panel, each of the back major panels substantially overlying one of pairs of first and second major panels.

* * * * *